US009559437B2

(12) United States Patent
Stieghorst et al.

(10) Patent No.: US 9,559,437 B2
(45) Date of Patent: Jan. 31, 2017

(54) MULTI-POLE CABLE CONNECTION AND METHOD FOR PRODUCING A MULTI-POLE CABLE CONNECTION

(71) Applicant: PHOENIX CONTACT GMBH & CO. KG, Blomberg (DE)

(72) Inventors: Lothar Stieghorst, Schlangen (DE); Dietmar Dux, Detmold (DE); Udo Haumersen, Detmold (DE); Markus Becker, Paderborn (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 93 days.

(21) Appl. No.: 14/353,496

(22) PCT Filed: Oct. 24, 2012

(86) PCT No.: PCT/EP2012/004441
§ 371 (c)(1),
(2) Date: Apr. 23, 2014

(87) PCT Pub. No.: WO2013/060448
PCT Pub. Date: May 2, 2013

(65) Prior Publication Data

US 2014/0302697 A1 Oct. 9, 2014

(30) Foreign Application Priority Data

Oct. 24, 2011 (EP) ..... 11186401

(51) Int. Cl.
*H01R 13/52* (2006.01)
*H01R 4/24* (2006.01)
(Continued)

(52) U.S. Cl.
CPC ..... *H01R 4/2416* (2013.01); *H01R 12/675* (2013.01); *H01R 13/504* (2013.01); *H01R 13/521* (2013.01); *H01R 43/24* (2013.01)

(58) Field of Classification Search
CPC . H01R 13/523; H01R 13/5219; H01R 4/2433; H01R 9/0757; H01R 13/5216
(Continued)

(56) References Cited

U.S. PATENT DOCUMENTS 4,335,932 A * 6/1982 Herrmann, Jr. ..... B29C 33/0016 174/541
4,475,786 A * 10/1984 Root ..... H01R 12/675 439/404
(Continued)

FOREIGN PATENT DOCUMENTS

DE 1046866 B 12/1958
EP 2077181 A2 7/2009
(Continued)

*Primary Examiner* — Thanh Tam Le
(74) *Attorney, Agent, or Firm* — Leydig, Voit & Mayer, Ltd.

(57) ABSTRACT

A method for producing a multi-pole cable connection includes disposing a plurality of contact elements in respective openings of a carrier element. A free end of each contact element protrudes from the respective openings and projects from a surface of the carrier element. The method also includes applying a flat sealing element to the carrier element so as to guide the sealing element over the free ends of the contact elements projecting from the surface of the carrier element, pressing the scaling element onto the surface of the carrier element. The method includes forming a contact of a plurality of conductors of a cable and the contact elements. The conductors are clamped onto the contact elements. The method also includes coating the contact with a potting material to form a component composite.

12 Claims, 4 Drawing Sheets

(51) Int. Cl.
*H01R 12/67* (2011.01)
*H01R 13/504* (2006.01)
*H01R 43/24* (2006.01)

(58) Field of Classification Search
USPC ..... 439/204, 271, 404, 405, 417, 936
See application file for complete search history.

(56) References Cited

U.S. PATENT DOCUMENTS 4,668,039 A * 5/1987 Marzili ..... H01R 12/675 439/404
4,875,870 A * 10/1989 Hardy ..... H01R 13/5216 174/76
4,946,390 A 8/1990 Smyers
5,326,286 A * 7/1994 Bixler ..... H01R 12/675 439/405
5,501,612 A * 3/1996 Green ..... H01R 4/70 439/499
5,535,512 A * 7/1996 Armogan ..... H01R 13/5202 29/877
5,588,856 A * 12/1996 Collins ..... H01R 13/5208 439/204
5,752,840 A * 5/1998 Wu ..... H01R 12/675 439/485
5,934,922 A * 8/1999 Chiotis ..... H01R 13/5208 439/204
6,196,863 B1 * 3/2001 Schwant ..... H01R 12/67 439/417
6,299,473 B1 * 10/2001 Schwarz ..... H01R 12/67 439/404
6,500,027 B1 * 12/2002 Van Der Sanden . H01R 13/216 439/587
6,811,430 B1 * 11/2004 Carrico ..... H01R 4/2433 439/409
6,960,380 B2 11/2005 Buekers et al.
7,393,218 B1 7/2008 Pavlovic
2002/0157843 A1 10/2002 Fukushima et al.
2005/0164542 A1 7/2005 Wu
2010/0075535 A1 3/2010 Mizutani et al.

FOREIGN PATENT DOCUMENTS

JP 0742018 U 7/1995
RU 2256992 C2 7/2005

* cited by examiner

MULTI-POLE CABLE CONNECTION AND METHOD FOR PRODUCING A MULTI-POLE CABLE CONNECTION

CROSS-REFERENCE TO RELATED APPLICATIONS

This application is a U.S. National Phase application under 35 U.S.C. §371 of International Application No. PCT/EP2012/004441, filed on Oct. 24, 2012, and claims benefit to European Patent Application No. EP 11 18 6401.3, filed on Oct. 24, 2011. The International Application was published in German on May 2, 2013 as WO 2013/060448 A1 under PCT Article 21 (2).

FIELD

The invention relates to a method for producing a multi-pole cable connection and to a multi-pole cable connection itself.

BACKGROUND

Multi-pole cable connections normally consist of a cable, which comprises a large number of conductors, and a connector part, which is arranged directly on the cable and in which the conductors of the cable are connected to contact elements to form a contact. The contact elements are arranged inside openings of a carrier element of the connector part, the openings being formed as through-openings so that the contact elements, which are connected to the conductors to form a contact, can each be connected with a mating contact element to form a contact, which can, for example, be fitted onto a free end of a contact element within a respective opening on the carrier element. A disadvantage with these cable connections is that they are generally susceptible to moisture or dirt and therefore their service life is generally reduced.

SUMMARY

In an embodiment, the present invention provides a method for producing a multi-pole cable connection comprising disposing a plurality of contact elements in respective openings of a carrier element. A free end of each contact element protrudes from the respective opening and projects from a surface of the carrier element. The method also includes applying a flat sealing element to the carrier element so as to guide the sealing element over the free ends of the contact elements projecting from the surface of the carrier element and press the sealing element onto the surface of the carrier element. The method includes forming a contact of a plurality of conductors of a cable and the contact elements. The conductors are clamped onto the contact elements. The method also includes coating the contact with a potting material to form a component composite.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
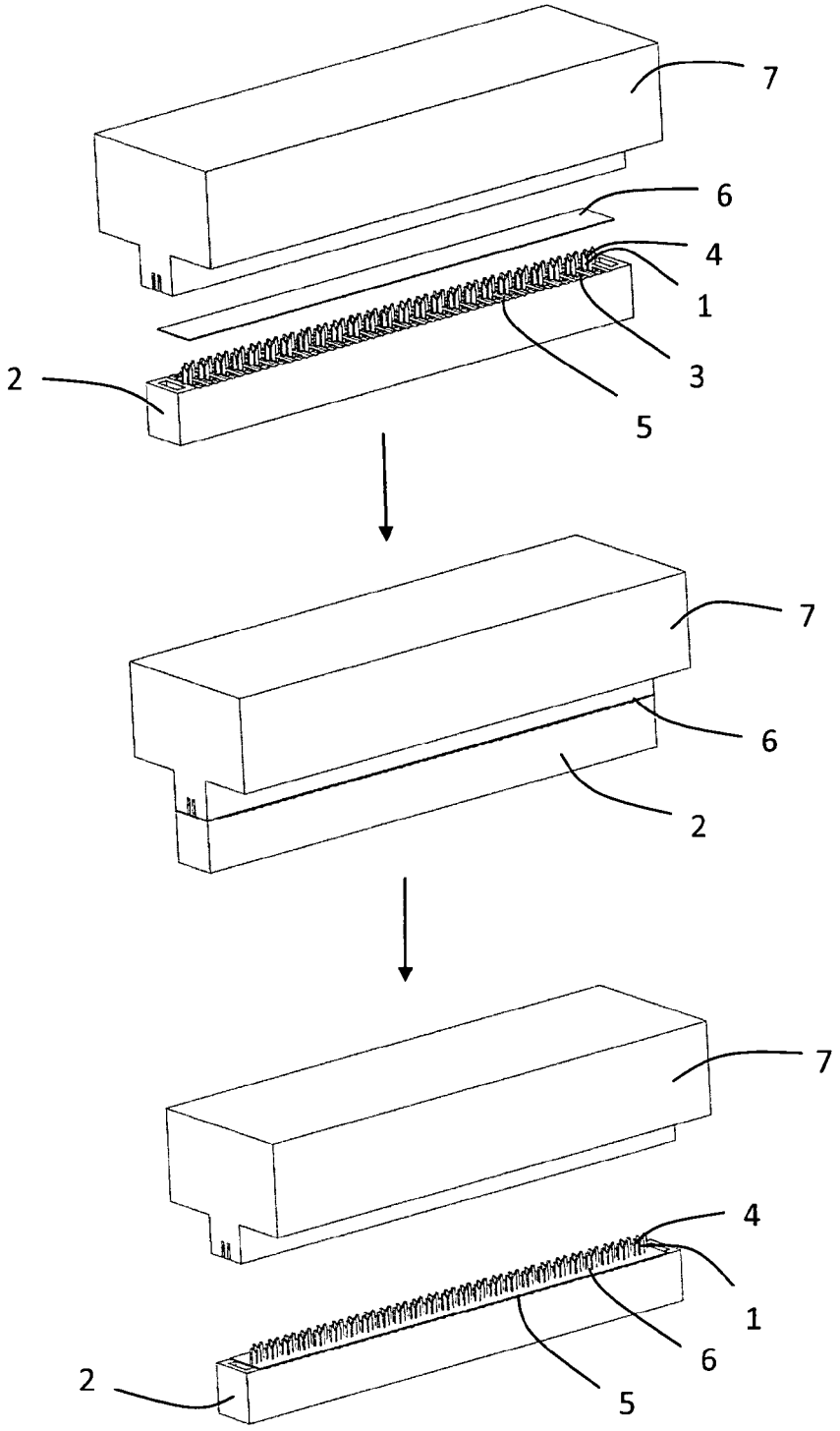
FIG. 1 shows a schematic view of the application of a sealing element during the production of a multi-pole cable connection according to the invention.

An aspect of the present invention provides for the increase of resistance of a multi-pole cable connection to environmental influences and also the increase of the duration of the functionality of a multi-pole cable connection.

In an embodiment, the present invention provides arranging a plurality of contact elements on a carrier element, the contact elements being arranged in openings formed on the carrier element in such a way that a free end formed on the contact elements protrudes from the respective opening and projects from a surface of the carrier element; applying a flat sealing element to the carrier element in such a way that the sealing element is guided over the free ends of the contact elements projecting from the surface of the carrier element and pressed onto the surface of the carrier element; forming a contact of a plurality of conductors of a cable with the contact elements, the conductors being clamped onto the contact elements and coating the contact with a potting material to form a component composite.

Furthermore, in an embodiment, the multi-pole cable connection has a carrier element, a plurality of contact elements inserted into openings formed on the carrier element, a free end of the contact elements protruding from the respective openings and projecting from a surface of the carrier element in an inserted state of the contact elements in the carrier element, a flat sealing element, which rests on the surface of the carrier element, the free ends of the contact elements being inserted through the sealing element, and a cable having a plurality of conductors, the conductors of the cable being clamped onto the contact elements to form a contact and the contact being coated with a potting material to form a component composite.

The method according to an embodiment of the present invention for producing a multi-pole cable connection provides that the contact is now coated and thus a type of protective sleeve is formed around the contact. Because of this, the contact is protected in particular from environmental influences such as moisture and dirt, whereby the service life and thus the duration of functionality of the contact and of the multi-pole cable connection can be increased. Moreover, by coating the region between the cable and the carrier element having the contact elements mounted thereon with a potting material, a secure fixing of the cable to the carrier element having the contact elements mounted thereon can be achieved. In order to prevent the potting material from being able to penetrate the openings of the carrier element during coating of the contact and the openings being affected by this, in that a contact of the contact element inserted into the opening with a mating contact element would no longer be possible and the cable connection would therefore constitute a reject, the invention is further characterised in that by providing a sealing element, the potting material used for the coating can only penetrate the intended regions during coating of the contact of the conductors to be connected to form a contact with the contact elements, it being possible in particular to prevent a penetration of the potting material into the openings on the carrier element. Because no potting material can now penetrate the openings, a simultaneous coating by the potting material can be prevented of the region of the contact elements, which is positioned inside the openings and on which a mating contact element can be arranged to form a contact, which coating would make a contact with a mating contact element difficult or no longer possible. This is achieved in that before the coating process with a potting material, a sealing element is applied to the carrier element which unilaterally seals the openings of the carrier element in which the contact elements are arranged and prevents a direct contact of the potting material with the carrier element at least in the region of these openings. In the process, the sealing element is applied in such a way that the free ends of the contact elements protruding from the surface of the carrier element are guided through the sealing element in such a way that the sealing element is located such that it forms a seal directly on the free ends in the region of the surface of the carrier element. The sealing element can thus prevent the potting material from being able to penetrate the openings of the carrier element via the lateral regions of the free ends of the contact elements. A multi-pole cable connection constructed thus is characterised by a high level of functionality and functional reliability so that the reject rate of the cable connections produced can be substantially reduced.

Firstly, in order to produce such a cable connection, the contact elements are inserted into the openings of the carrier element, one contact element preferably being inserted into each opening. In the process, the contact elements are not inserted fully into the openings but rather a free end of the contact elements still protrudes from the openings even in the inserted state so that this free end projects from a surface, in particular an outer surface, of the carrier element. Following insertion of the contact elements into the carrier element, a sealing element is pressed onto and against the surface of the carrier element, from which the free ends of the contact elements project so that the sealing element lies flat on the surface. In order to achieve this, the sealing element is guided over the free ends of the contact elements using a press tool, it being possible for the sealing element to already have prepared recesses or perforations in the region of the free ends so that the free ends can push through the sealing element. The sealing element forms a thin layer on the surface of the carrier element, sealing the openings, the sealing element being located so as to form a seal on the lateral regions of the free end of the contact element where the free end protrudes from the opening. In a next step, the conductors of a cable are connected to the contact elements via the free ends of the contact elements, the connection region of the conductors having the contact elements being formed above the sealing element so that the sealing element is arranged between the connection region of the conductors having the contact elements and the surface of the carrier element. Following the formation of the contact, the contact is coated with a potting material so that a component composite, which forms the contact connection in the form of a connector part, is formed. The carrier element and the conductors connected via the contact elements are placed into a tool mould for this purpose.

According to a preferred configuration of the method according to the invention, the coating is carried out in two stages, the coating being carried out at a lower pressure in a first stage than in a second stage subsequent to the first stage. The quality of the produced cable connections can be improved by means of the two-stage coating process since the elements to be coated by the two-stage coating process can be subjected to a lower load during coating due to the option of using different levels of pressure. In the first stage, coating is preferably carried out at a low pressure in order to prevent the sealing element from being damaged in the coating process. The first stage of the coating thus serves primarily to fix the individual elements in their positions. In a second stage, coating is carried out at a higher pressure, it being possible to ensure that the potting material can penetrate all the indentations provided in the tool mould and thus be given its final shape. By means of the second stage of coating, the final form of the cable connection is thus formed. The tool mould is preferably changed over in the transition from the first stage to the second stage.

Alternatively it can, however, also be provided for the coating to be carried out in one stage so that only one tool mould is necessary and the contact is coated in one work step.

Furthermore, it is preferably provided for a sleeve body to receive a fixing screw to be coated at the same time during the formation of the component composite. For this purpose, the sleeve body is also placed into the tool mould before the coating of the contact, preferably on the domes formed in the tool mould, so that the sleeve body is coated at the same time as the contact and is thus also fixed directly into the component composite without having to provide an additional work step. The sleeve body can thus be fixed with lower manufacturing costs, without a substantial extension of the total production time of the cable connection. If the coating is carried out in two stages, the sleeve body is preferably also already coated in the first stage. It is thus preferably provided for the cable connection to have a sleeve body to receive a fixing screw, which is also coated in the component composite.

Furthermore, it is preferably provided for a shield arranged on the cable to be connected to a cable shoe before the coating process and for the cable shoe also to be coated when the component composite is formed. The shield can, for example, be provided in the form of a braided shield formed on the cable. The shield can be connected to a cable shoe via a crimping process, it being possible to place a ring of the cable shoe onto a sleeve body before the coating process in order to achieve a defined position of the cable shoe in the component composite. During the coating process the cable shoe is coated with the potting material both in the region of the connection to the shield and in the region of the ring, which is resting on the sleeve body. In the case of a two-stage coating process, the cable shoe is preferably also already coated in the first stage. As a result of this a cable connection can be formed in which a shield arranged on the cable is connected to a cable shoe and the cable shoe is also coated in the component composite.

A further preferred configuration of the invention provides for a thermoplastic hot melt adhesive, preferably a polyamide-based thermoplastic hot melt adhesive, to be used as the potting material. The potting material in the form of a thermoplastic hot melt adhesive is characterised by good adhesion, as a result of which high density values and strengths are achieved with the coated elements. As a result of the relatively low viscosity of the hot melt adhesive, it can be introduced into the tool mould at a relatively low pressure so that it can also flow gently around delicate elements and they can thus be sealed and protected. The hot melt adhesive can be introduced into a cold tool mould where heat is extracted from the hot melt adhesive, which generally only takes a few seconds. Then the finished component composite, which forms the cable shoe in the form of a connector part, can be removed from the tool mould. If a polyamide-based hot melt adhesive is used, a substantially higher mechanical strength can be achieved in addition to the secure protection from the penetration of moisture.

In order to increase the functionality of the sealing element in relation to its sealing action and in order to increase the certainty that the sealing element will not be damaged during the coating process, it is also preferably provided for the sealing element to be applied to the carrier element in two layers.

Paper and/or plastic film is preferably used as the sealing element. The sealing element preferably has a minimal thickness, is flat and can easily be separated or cut away, particularly when displacement contact elements are used as the contact elements. Moreover, the sealing element preferably has a low weight.

In order to effectively secure the contact of the conductors to the contact elements and in particular to be able to prevent the conductors from detaching from the contact elements during the coating process, the conductors clamped to the contact elements are preferably fixed with a clamping bracket that engages in the carrier element during the formation of the contact. The clamping bracket overlaps the conductors in the region of the introduction of the conductors into the contact elements, preferably over the whole length of the carrier element. Additional pressure can be exerted on the contact points of the conductors with the contact elements via the clamping bracket so that the conductors can also be pressed into the contact elements with the clamping bracket to form the contact. The clamping bracket preferably has a locking arm on each of its two ends, via which the clamping bracket can be hooked onto the carrier element and fixed so that it stays in place.

According to another preferred configuration of the invention, displacement contact elements are used as the contact elements, the free end of which that projects from the surface of the carrier element has a cutting blade, the sealing element being cut through in the region of the cutting blade when the sealing element is guided over the free end. When displacement contact elements are used, it is not necessary for corresponding recesses or perforations, through which the contact elements can be guided, to be introduced into the sealing element before it is applied to the carrier element since, if displacement contact elements are used, the sealing element is cut through when it is guided over the cutting blades of the displacement contact elements precisely in the region of the cutting blades or displacement contact elements, as a result of which a particularly precise adjustment of the size of the recesses introduced into the sealing element for the contact elements to be passed through can be achieved, so that the sealing element can rest particularly tightly on the contact elements in a state where it is pressed against the surface of the carrier element. As a result of this, both the time and cost of manufacturing a cable shoe can be reduced since the sealing element does not have to be processed in an additional work step. Moreover, a particularly good accuracy of fit of the sealing element can be achieved in the process in the region of the contact elements in a state where it is pressed against the surface.

If the contact elements are in the form of displacement contact elements, non-stripped conductors can be used as the conductors, insulation surrounding the conductors being pressed into the cutting blade of a displacement contact element and cut through when the contact is formed. The contact can thus be formed in a short time, as a result of which the manufacturing time of a cable connection can be reduced still further.

The invention is described in more detail hereinafter with reference to the accompanying drawings.

Figure 6:
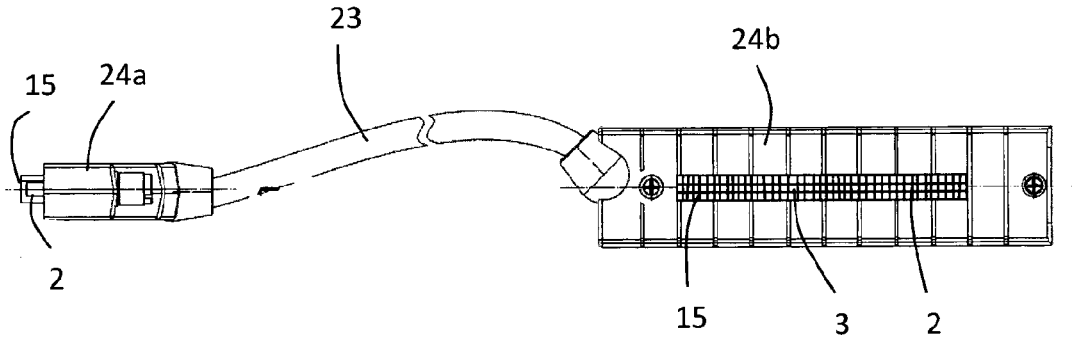
FIG. 6 shows a schematic view of a cable with two multi-pole cable connections formed as a connector part on the cable.

During the production of a multi-pole cable connection 24*a*, 24*b*, as shown in FIG. 6, firstly a plurality of contact elements 1, which are in the form of displacement contact elements in the embodiment shown here, are arranged on a carrier element 2, which can be designed in the form of a female connector. As can be seen for example in FIG. 1, the carrier element 2 here is designed in the form of a rectangular box, a plurality of openings 3 formed as through-openings being formed in the carrier element 2. The contact elements 1 are inserted into the openings 3 and fixed there. In the process, the contact elements 1 are not fully inserted into the openings 3, but rather a free end 4 of the contact elements 1 protrudes out of the respective opening 3 in which the contact element 1 has been inserted in a state where the contact elements 2 are already fixed inside the openings 3, so that this free end 4 projects from a surface 5 of the carrier element 2. The free end 4 is designed in the form of a substantially V-shaped cutting blade in the embodiment shown here.

In FIG. 1, the application of a sealing element 6 is shown, which is arranged on the surface 5 of the carrier element subsequent to the insertion of the contact elements 1 into the openings 3 of the carrier element. The sealing element 6 is flat and designed in the form of a thin strip. The sealing element 6 can be single-layered, but preferably double or multi-layered. The sealing element 6 can be made for example from paper or a plastic film.

During the arrangement of the sealing element 6 on the carrier element 2, the sealing element 6 is guided over the free ends 4, here the cutting blades, projecting from the surface 5 of the carrier element 2 using a press tool 7 and pressed flat onto the surface 5, as can be seen in the central view of FIG. 1. When the sealing element 6 is being guided over the free ends 4, the sealing element 6 is cut into or cut through by the cutting blades formed on each of the free ends 4 in the region of the free ends 4 so that the free ends 4 can be pressed through the sealing element 6.

After the sealing element 6 has been pressed down, the press tool 7 is removed, as can be seen in the lower view of FIG. 1. The pressed sealing element 6 now lies flat on the surface 5 of the carrier element 2 so that the openings 3 of the carrier element 2 are covered by the sealing element 6 and thus sealed on this side. In the region where the free ends 4 of the contact elements 1 push through the sealing element 6, the sealing element 6 rests tight on the free ends 4 of the contact elements 1, in particular the lateral regions of the free ends 4.

Figure 2:
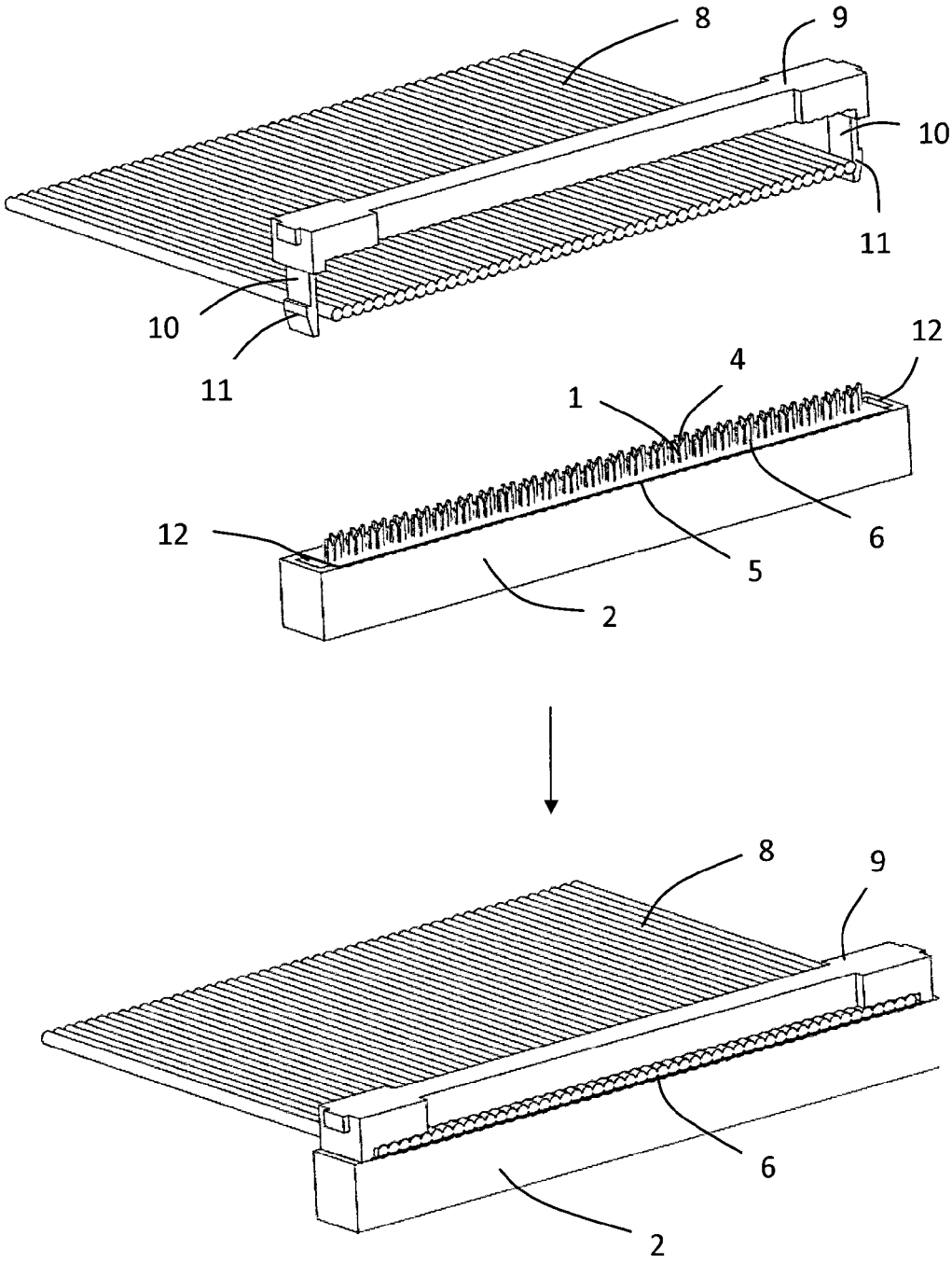
FIG. 2 shows a schematic view of the formation of a contact during the production a multi-pole cable connection according to the invention.

In FIG. 2 a subsequent process step is shown, in which a contact of the contact elements 1 is formed with a plurality of conductors 8 of a cable 23, as shown in FIG. 6. The conductors 8 grouped together in a bundle in the cable 23 are arranged next to each other for contacting so that they lie in a row and are pressed into the contact elements 1 using a clamping bracket 9. As an alternative to the embodiment of a round cable 23 shown in FIG. 6, the cable can also be in the form of a flat ribbon cable. The clamping bracket 9 is formed in the shape of a beam and has substantially the same length as the carrier element 2 so that the clamping bracket 9 can span the conductors 8 to be connected to the contact elements 1 and apply an even force onto the conductors 8. The clamping bracket 9 has a locking arm 10 on each of the end portions with a latch 11 formed thereon, which can be hooked or engaged into recesses 12 formed in the carrier element 2, as can be seen in the lower view of FIG. 2. The clamping bracket 9 serves, on the one hand, to press the conductors 8 into the contact elements 1 in order to clamp them onto the contact elements 1 and, on the other hand, the clamping bracket 9 acts as a fixing means for the conductors 8, which have already been clamped. During a subsequent coating of the contact the clamping bracket 9 is thus also coated at the same time.

Since the contact elements 1 here are in the form of displacement contact elements, non-stripped conductors are used in the embodiment shown here so that when the contact is formed, insulation surrounding the conductors 8 is pressed into the free end 4 of the contact elements 1 formed with a cutting blade and cut through in the process.

Subsequent to the formation of the contact by clamping the conductors 8 to the contact elements 1, the contact is coated, the coating being carried out in two stages in the embodiment shown here. The region of the contact is placed into a tool mould for the coating process. In the process, the contact to be coated comprises the conductors 8 brought out of the cable 23, the clamping bracket 9 and an upper side 13 of the carrier element 2 on which the conductors 8 are clamped onto the contact elements 1. The lateral surfaces 14 of the carrier element 2 can be at least partially coated at the same time. The underside 15 of the carrier element 2, however, is not coated at the same time because mating contact elements are inserted into the openings via the underside 15 to form a contact with the contact elements 1 after the completion of the cable connection 24*a*, 24*b*.

Figure 3:
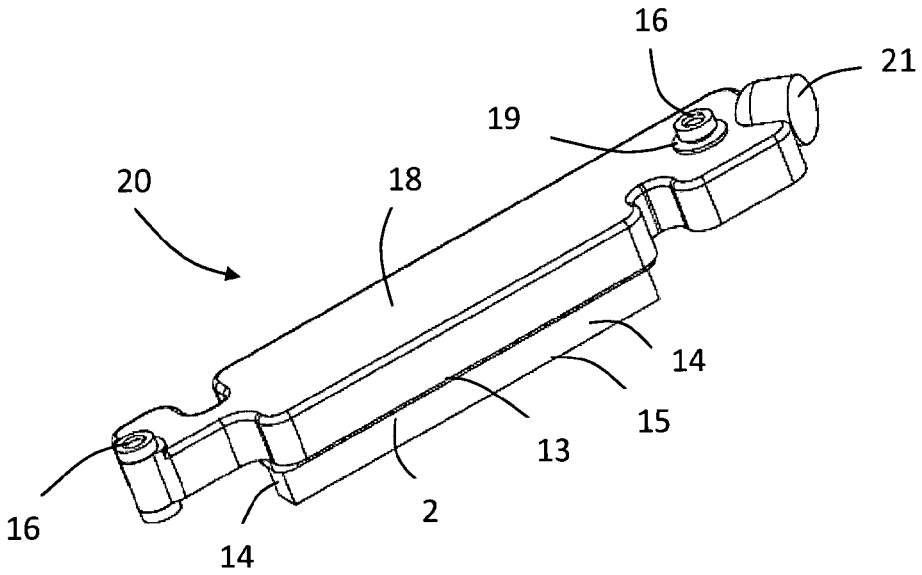
FIG. 3 shows a schematic view of a component composite of a multi-pole cable connection according to the invention subsequent to a first coating process.
Figure 4:
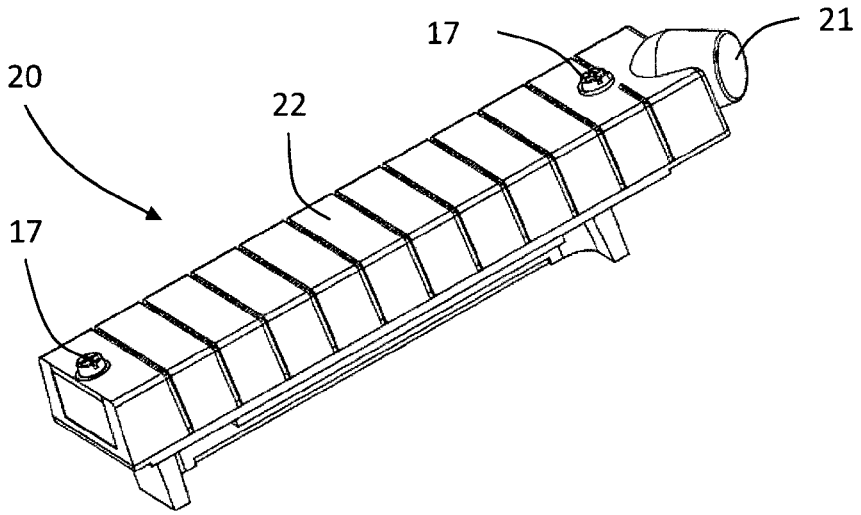
FIG. 4 shows a schematic view of a component composite of a multi-pole cable connection according to the invention subsequent to a second coating process.

In FIG. 3, a contact coated with a first potting material 18 is shown after the first coating process to form a component composite 20, two sleeve bodies 16, into which fixing screws 17 can be screwed later, as shown in FIG. 4, also being coated at the same time in addition to the contact. Furthermore, a cable shoe 19 is provided in the embodiment shown here, a first end of which is connected to a shield of the cable 23 and which has a ring, which is placed on a sleeve body 16 before the coating process, on a second end opposite the first end, as is shown in FIG. 3. Furthermore, the component composite 20 formed by the coating process has a connection region 21 on a lateral region at which the component composite 20 and thus the potting material 18 connect to a cable.

Following the first coating process, the component composite 20 is removed from a first tool mould in which the first coating process was performed and placed into a second tool mould. A second coating process takes place in the second tool mould at a higher pressure than during the first coating process and in which the component composite 20 is coated with a second potting material 22, which fully covers the first potting material 18. After the second coating process, the completely formed cable connection 24*a*, 24*b* is removed from the tool mould.

Preferably the same material, preferably a thermoplastic hot met adhesive, in particular a polyamide-based hot melt adhesive, is used as the first potting material 18 and as the second potting material 22.

Figure 5:
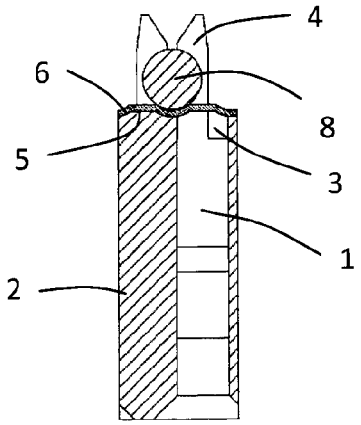
FIG. 5 shows a schematic sectional view of a contact of a multi-pole cable connection according to the invention.

In FIG. 5 a section through a carrier element 2, a contact element 1 arranged inside an opening 3 of the carrier element 2, a sealing element 6 arranged on the surface 5 of the carrier element 2 and a conductor 8 clamped onto the contact element 1 are shown, it being possible to see here that the sealing element 6 rests flat on the surface 5 and fully seals the latter so that the clamped conductor 8 also rests on the sealing element 6 and does not come into contact with the surface 5 of the carrier element 2.

FIG. 6 shows a cable 23, which has a cable connection 24*a*, 24*b* formed as a connector part on each of its two ends, which cable connections are produced in the process steps shown in FIGS. 1-5. As can be seen in FIG. 6, the underside 15 of the carrier elements 2 is not coated in potting material 18, 22, but the openings 3 in the carrier element 2 are freely accessible from the underside 15 so that a mating contact element can be inserted securely and unhindered into each of the openings 3 to form a contact with the contact elements 1 arranged inside the openings 3.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS contact element 1
carrier element 2
opening 3
free end 4
surface 5
sealing element 6
press tool 7
conductor 8
clamping bracket 9
locking arm 10
latch 11
recess 12
upper side 13
lateral surface 14
underside 15
sleeve body 16
fixing screw 17
potting material 18
cable shoe 19 component composite 20
connection region 21
potting material 22
cable 23
cable connection 24*a*, 24*b*

The invention claimed is:

1. A method for producing a multi-pole cable connection, the method comprising:

disposing a plurality of contact elements in respective openings of a carrier element such that a free end of each contact element protrudes from the respective opening and projects from a surface of the carrier element;

applying a flat sealing element to the carrier element so as to guide the sealing element over the free ends of the contact elements projecting from the surface of the carrier element and press the sealing element onto the surface of the carrier element;

forming a contact of a plurality of conductors of a cable and the contact elements, the conductors being clamped onto the contact elements; and coating the contact with a potting material to form a component composite, wherein the sealing element is made from paper, wherein the contact elements are displacement contact elements having free ends with cutting blades, the sealing element being cut through in a region of the cutting blades when the sealing element is guided over the free ends; and wherein the sealing element is applied to the carrier element in two layers.

2. The method as recited in claim 1 wherein the coating the contact has two stages including a first stage that is carried out at a lower pressure than a second stage subsequent to the first stage.

3. The method as recited in claim 1 further comprising coating a sleeve body during the formation of the component composite, the sleeve body being adapted to receive a fixing screw.

4. The method as recited in claim 1 further comprising connecting a shield disposed on the cable to a cable shoe prior to the coating of the contact, the cable shoe being coated during the formation of the component composite.

5. The method as recited in claim 1, wherein the potting material is a thermoplastic hot melt adhesive.

6. The method as recited in claim 1, wherein the conductors clamped to the contact elements are fixed with a clamping bracket, the clamping bracket engaging the carrier element during the formation of the contact.

7. The method as recited in claim 1, wherein the conductors are non-stripped conductors and insulation surrounding the conductors is pressed into the cutting blades of the displacement contact elements and cut through during the formation of the contact.

8. A multi-pole connection comprising:

a carrier element;

a plurality of contact elements disposed in respective openings of the carrier element, a free end of each contact element protruding from the respective opening and projecting from a surface of the carrier element in an inserted state of the contact elements in the carrier element;

a flat sealing element disposed on the surface of the carrier element, the free ends of the contact elements being guided through the sealing element; and a cable having a plurality of conductors clamped onto the contact elements so as to form a contact, the contact being coated with a potting material so as to form a component composite, wherein the sealing element is made from paper, wherein the contact elements are displacement contact elements having free ends with cutting blades, the sealing element being cut through in a region of the cutting blades when the sealing element is guided over the free ends; and wherein the sealing element is arranged on the carrier element in two layers.

9. The multi-pole cable connection as recited in claim 8 further comprising a sleeve body adapted to receive a fixing screw, the sleeve body being coated in the component composite.

10. The multi-pole cable connection as recited in claim 8 further comprising a shield disposed on the cable and connected to a cable shoe, the cable shoe being coated in the component composite.

11. The multi-pole cable connection as recited in claim 8, wherein the potting material is a thermoplastic hot melt adhesive.

12. The multi-pole cable connection as recited in claim 8, wherein the conductors clamped onto the contact elements are fixed with a clamping bracket, the clamping bracket engaging the carrier element.

* * * * *